United States Patent [19]

Fisher, Jr.

[11] Patent Number: 4,697,859

[45] Date of Patent: Oct. 6, 1987

[54] FLOATING COAXIAL CONNECTOR

[75] Inventor: Robert L. Fisher, Jr., Hummelstown, Pa.

[73] Assignee: AMP Incorporated, Harrisburg, Pa.

[21] Appl. No.: 897,185

[22] Filed: Aug. 15, 1986

[51] Int. Cl.[4] ..... H01R 13/434; H01R 13/64

[52] U.S. Cl. ..... 439/246; 439/556

[58] Field of Search ..... 339/64 R, 64 M, 126 RS, 339/126 J, 129, 217 S, 177 R, 177 E

[56] References Cited

U.S. PATENT DOCUMENTS

| | | | |
|---|---|---|---|
| 3,091,748 | 5/1963 | Takes et al. | 339/65 |
| 3,094,364 | 6/1963 | Lingg | 339/64 |
| 4,112,282 | 9/1978 | Piber | 339/126 RS |
| 4,227,765 | 10/1980 | Neumann et al. | 339/143 |
| 4,426,127 | 1/1984 | Kubota | 339/177 |
| 4,445,745 | 5/1984 | Cartesse | 339/177 R |
| 4,580,862 | 4/1986 | Johnson | 339/64 R |

FOREIGN PATENT DOCUMENTS

| | | | |
|---|---|---|---|
| 2128038 | 4/1984 | United Kingdom | 339/64 R |

*Primary Examiner*—Gil Weidenfeld
*Assistant Examiner*—Gary F. Paumen

[57] ABSTRACT

An electrical connector 12 for snap-in mounting in an aperture 19 of a panel 13, comprises, a connector body 60 having an outer contact 69 and a passageway 62 receiving an outer conductor 26 of a coaxial cable 21, a grip ring 66 wedged against an internal wall of said passageway 62 and surrounding said outer conductor 26, a center contact 67 having a rearward portion for fitted connection with a center conductor 27 of the coaxial cable 21, a tapered surface 102 on a front end of said connector body 60 for impingement by a complementary connector 14 during mating, a split retention ring 79 surrounding the connector body 60 and being compressible inwardly during insertion into the aperture 19 of said panel 13 and thereafter expansible outwardly to engage the panel 13, a coil spring 83 surrounding the connector body 60 and having one end biased against the connector body 60 and the other end biased against said ring 79 to force the ring 79 against the panel 13, and a flange 77 on the connector body 60 for engaging against the panel 13.

10 Claims, 6 Drawing Figures

FLOATING COAXIAL CONNECTOR

BACKGROUND OF THE INVENTION

The present invention relates generally to electrical connectors and, more particularly, to coaxial connectors of the panel-mounted type which can be reliably connected, both electrically and mechanically, under diverse conditions of misalignment.

The modularization of electronic equipment often requires the mating of large number of connectors to electrically couple one component or module to another component or module. Frequently, the connectors are mounted to a panel; e.g., to the wall of a housing or other enclosure, or to a printed circuit board; and the modules are electrically coupled by mating the connectors on one panel with complementary connectors on a second panel.

An important requirement of electrical connectors is to provide reliable, noise-free transmission of the electrical signals between the coupled components or modules. This requirement is particularly critical in high frequency applications wherein the connectors must provide reliable connections at frequencies of 18 GHz or more. In such applications, each connector must be properly mated, both electrically and mechanically, to obtain proper system operation.

In some prior systems, proper mating was assured by individually screwing each connector on the first panel to its complementary connector on the second panel. Such a procedure can be time-consuming when large numbers of connectors must be mated (in many applications, 50 to 100 or more connectors are mounted on each panel), and, in many applicatins, is precluded by the physical location of the connectors. In many installations, the connectors must be mated at sites that are surrounded by or enclosed by other parts of the system. In rack and panel systems, for example, wherein a rack member in the form of a drawer or the like is inserted into a panel member, access to the individual connectors is frequently not possible during mating.

In rack and panel systems and in other systems wherein connectors must be "blind-mated" to one another, directly pluggable connectors of the "quick-connect and disconnect" type are generally used. In "blind-mated" systems, however, each connector on one panel should be accurately aligned with its complementary connector on the other panel to obtain proper mating when the panels are brought together. In the past, accurate alignment, in turn, has required that the system be manufactured to precise tolerances which greatly increases the cost of manufacturing the system.

To reduce the problem of connector misalignment and to permit a relaxation in manufacturing tolerance requirements, the connectors on one of the panels have been mounted so that they are capable of moving or "floating" relative to the panel to automatically align themselves with their complementary connectors during mating. Examples of "floating" connectors are shown in U.S. Pat. Nos. 3,091,748; 3,094,364; 4,227,765 and 4,580,862. Such known "floating" connector designs cannot be easily installed in the field. Additionally, in many such known designs, the connectors cannot be assembled until they are mounted to a panel in the field, thus presenting a problem of missing parts and system assembly in, frequently, an undesirable environment. In other designs, the connectors must be secured to the panel by a plurality of screws of other fastening elements which increases assembly time and cost and is inconvenient. In many designs also, the floating connectors cannot maintain proper mating when the connectors are subjected to various external forces during use.

SUMMARY OF THE INVENTION

The present invention provides an electrical connector which is adapted to be easily inserted into and retained in an aperture in a panel without the use of tools or fasteners. The connector comprises a connector body having at least one electrically conductive contact therein, and means for mounting the connector body to the panel when the connector body is inserted into the aperture. The mounting means includes resilient means for securely fastening the connector the panel when the connector body is merely pushed into the aperture in the panel, while allowing the connector to float and automatically compensate for a misaligned mating connector. The resilient means is movable both radially and axially relative to the connector body for permitting insertion of the connector body into the aperture and for thereafter preventing the withdrawal of the connector body from the aperture, and for resiliently supporting the connector body for movement relative to the panel to permit automatic alignment of the connector body with a complementary connector during the mating thereof.

In accordance with a presently preferred embodiment, the panel retaining means comprises a first means for defining a first flange, and a second means comprising a split retention ring loosely surrounding the connector body and defining a second flange that is urged toward the first means by spring means. During mounting of the connector body to the panel, the split retention ring is resilient and is compressed inwardly to permit insertion of the connector body into the aperture of the panel. When the connector body is completely positioned in the aperture, however, the ring will expand outwardly to prevent withdrawal of the connector body from the aperture. The spring means preferably comprises a spring which urges the split retention ring toward the first flange. For example, a coil spring can be positioned between the connector body and the retention ring so that the connector body can move within the panel aperture axially, radially and angularly, with respect to the panel, permitting the connector body to automatically align itself with a complementary connector during mating, even if they do not share a common axis before mating.

The connector of the present invention comprises a fully assembled unit which can be mounted to a panel either during manufacture or in the field by simply inserting it into an aperture in the panel. Final assembly of the connector during mounted is not required, nor are separate bolts, screws, or other fastening elements needed to secure the connector to the panel. With the present invention, a large number of connectors can be mounted to a panel rapidly and with a minimum of inconvenience, and panels carrying large numbers of connectors to be connected can be mated easily even if complementary pairs of connectors do not share a common axis.

Further advantages and specific details of the invention will become apparent hereinafter in conjunction with the following detailed description of the presently preferred embodiment.

DETAILED DESCRIPTION OF THE PREFERRED EMBODIMENT

Figure 1:
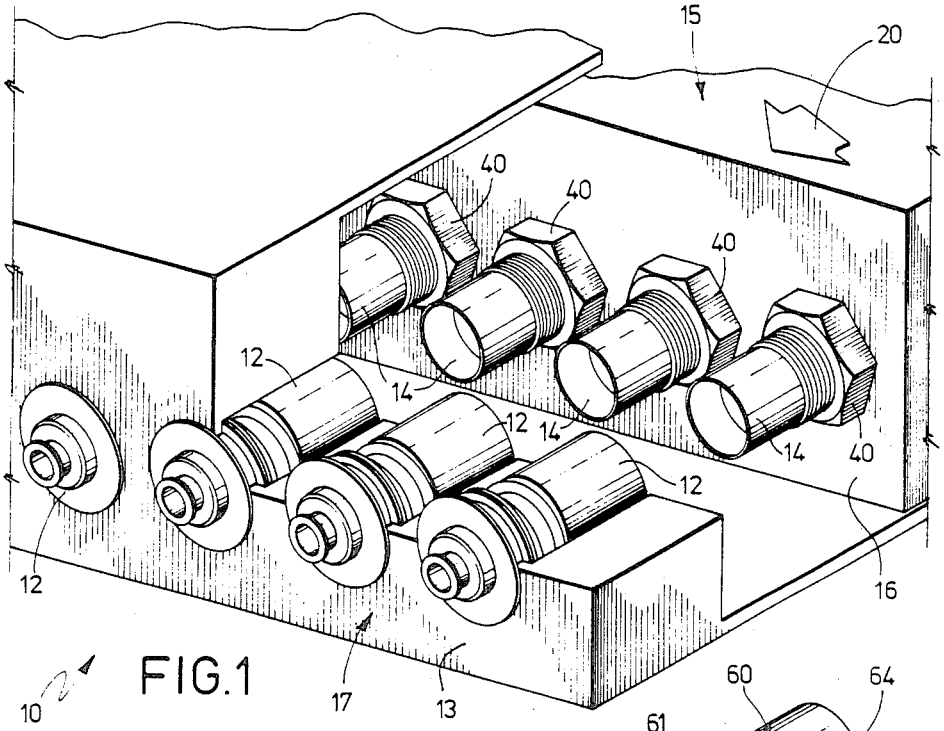
FIG. 1 is a perspective view of a rack and panel connector system for mating a plurality of connectors of a presently preferred embodiment of the invention.

FIG. 1 illustrates a portion of an electrical connector system 10 which includes a plurality of connectors 12 mounted to a first wall or panel 13, and a like plurality of connectors 14 mounted to a second panel or wall 16. FIG. 1 illustrates the invention in a rack and panel system in which panel 16 is incorporated within a movable rack member 15 in the form of a drawer, and panel 13 is incorporated within a stationary panel member 17. As is well-known to those skilled in the art, rack member 15 is movable into panel member 17 in the direction indicated by arrow 20 so simultaneously mate the plurality of connectors 14 on panel 16 with the plurality of connectors 12 on panel 13 to complete electrical circuits (not shown) through the connectors.

Only a portion of rack and panel system 10 is illustrated in FIG. 1. In practice, system 10 may include 50 to 100 or more connector pairs arranged in one or more rows or in other configurations on panel 13 and 16.

Figure 2:
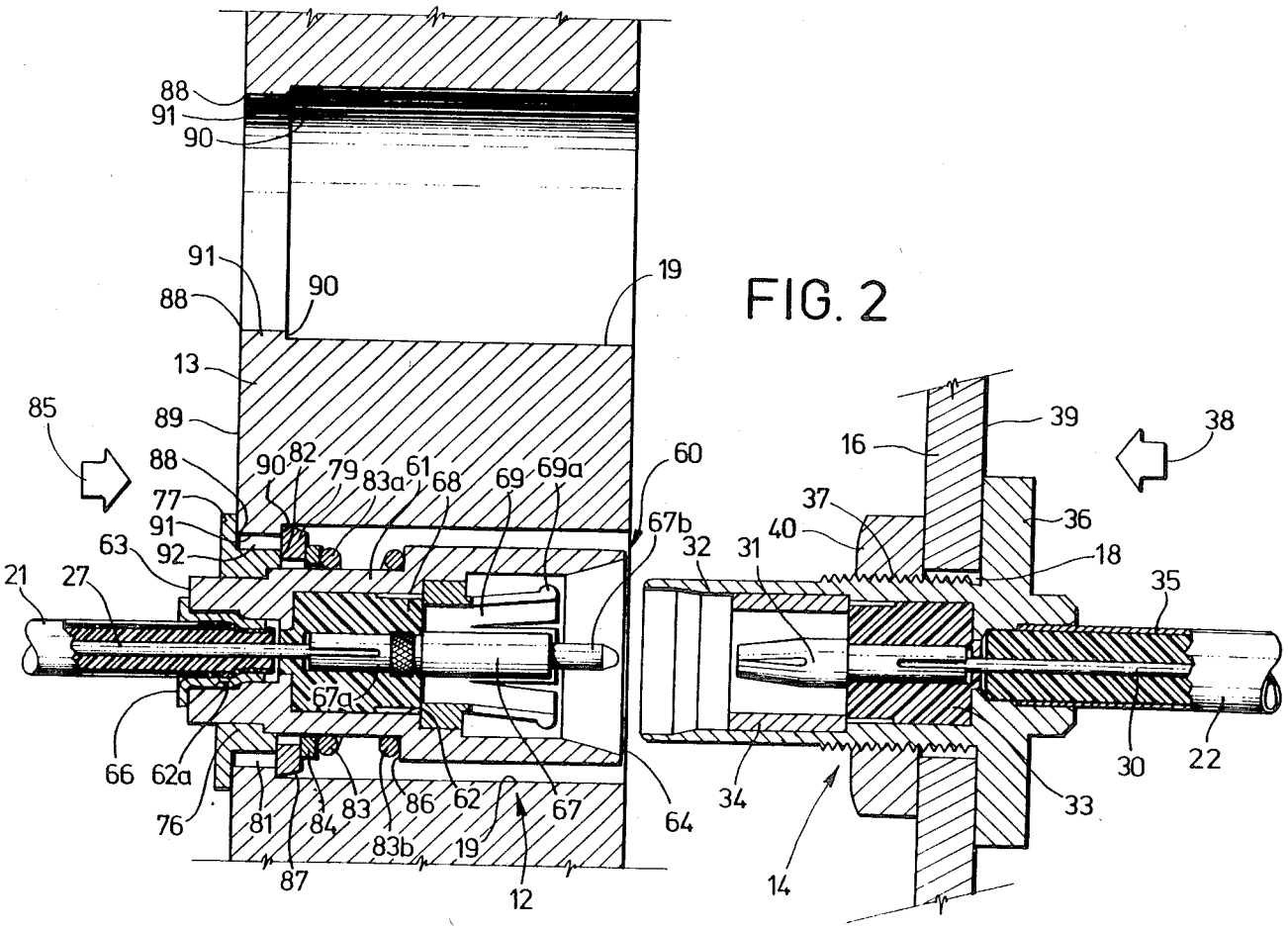
FIG. 2 is a cross-sectional view of the connectors of FIG. 1 mounted to their respective panels.

As shown in FIG. 2, connectors 14 may be jack connectors that extend through and are mounted within a plurality of apertures 18 in panel 16, and connectors 12 may be plug connectors that extend through and are mounted within a plurality of apertures 19 in panel 13. As will be explained hereinafter, panel 13 is preferably of a sufficient thickness that plug connectors 12 will be substantially fully positioned within apertures 19.

The connectors 12 and 14 comprise coaxial connectors adapted to terminate and connect a pair of coaxial cables 21 and 22. (The cables are not shown in FIG. 1, for clarity).

Jack connector 14 is of generally known construction and need not be described in great detail. Connector 14 includes an electrically conductive, center contact 31 supported axially within and electrically insulated from an electrically conductive outer shell 32. The connector is attached to the end of a coaxial cable 22 as known to those skilled in the art. Center contact 31 is electrically connected to the center conductor 30 of cable 22 and the outer conductive shell 32 is electrically connected to the outer conductor 35 of cable 22. The center contact 31 is electrically insulated from the outer shell 32 by an annular spacer or plug 33 formed of a suitable dielectric material. A tubular-shaped, electrically conductive outer contact 34 is positioned within shell 32 and is electrically coupled to outer conductor 35 via shell 32.

Outer shell 32 has an integral, outwardly extending, annular flange 36 adjacent the rear end thereof. At least a portion of the outer surface of shell 32 is also threaded as shown at 37. To mount jack connector 14 to panel 16, the connector is inserted into an aperture 18 in panel 16 in the direction indicated by arrow 38 until flange 36 contacts surface 39 of panel 16. A lock-nut 40 is then threaded onto the threaded portion 37 of shell 32 and tightened until panel 16 is firmly retained between flange 36 and lock-nut 40. After fastening, jack connector 14 is rigidly mounted to panel 16 and unable to move with respect to the panel.

Figure 3:
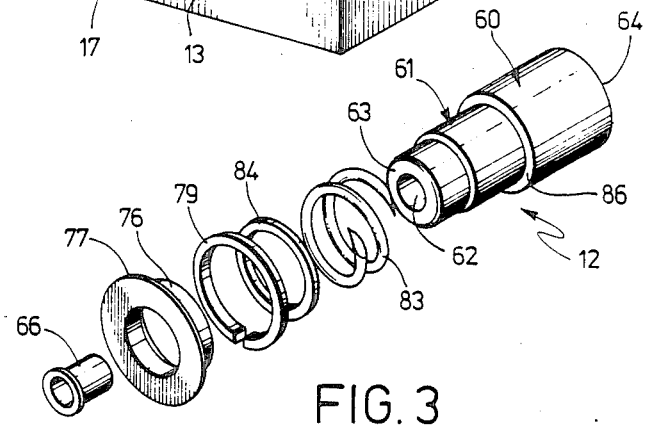
FIG. 3 is a partially exploded view of the plug connector of FIGS. 1 and 2.

Plug connector 12, illustrated in cross-section in FIG. 2, is also illustrated in exploded form in FIG. 3. Connector 12 comprises a connector body portion 60 which includes an outer shell or housing 61 of generally cylindrical shape, having an axial bore 62 of varying cross-sectional diameter extending therethrough from rear end 63 to front end 64 thereof. Connector body 61 is attached to the end of a coaxial cable 21 entering into the connector body 61 from rear end 63. Cable 21 is supported by a grip ring 66 which is press-fit or otherwise secured in rear passageway portion **62*a* as shown. The end of outer conductor 26 of the coaxial cable 21 is exposed and tightly surrounded by grip ring 66 when the grip ring 66 is moved forwardly to wedge against the internal wall of bore portion 62a to provide electrical coupling between the outer conductor 26 and the outer shell 61**.

Connector 12 also comprises a centrally located electrical contact 67, having a rearward portion **67*a* adapted to accept the center conductor of the coaxial cable. The center conductor 27 of coaxial cable 21 is adapted to extend into portion 67*a* of center contact 67 and be retained therein by force fit or the like. Center contact 67 is supportedd axially within outer shell 61 by an annular dielectric member 68 which both supports center contact 67 and electrically insulates it from outer shell 61. An exposed pin portion 67*b* of center contact 67 extends outwardly of the dielectric member to adjacent front end 64 of connector body portion 60, and is adapted to be received by center socket contact 31 in jack connector 14** when the two connectors are mated.

Figure 5:
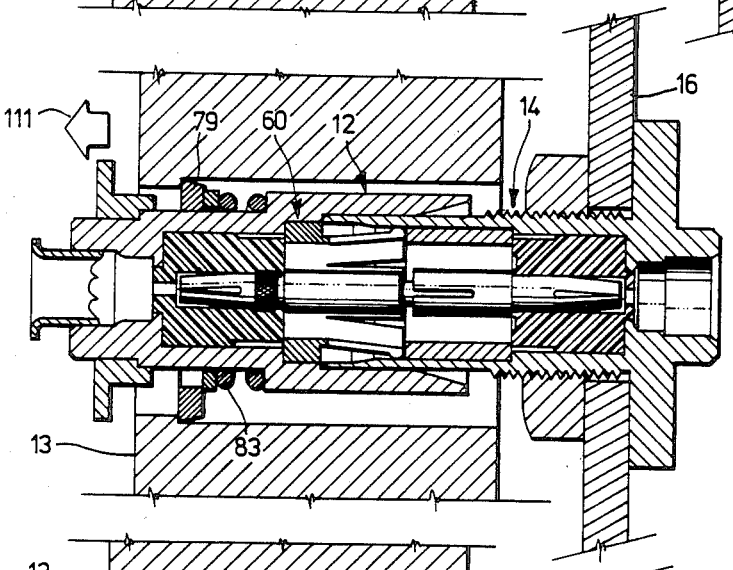
Figure 6:
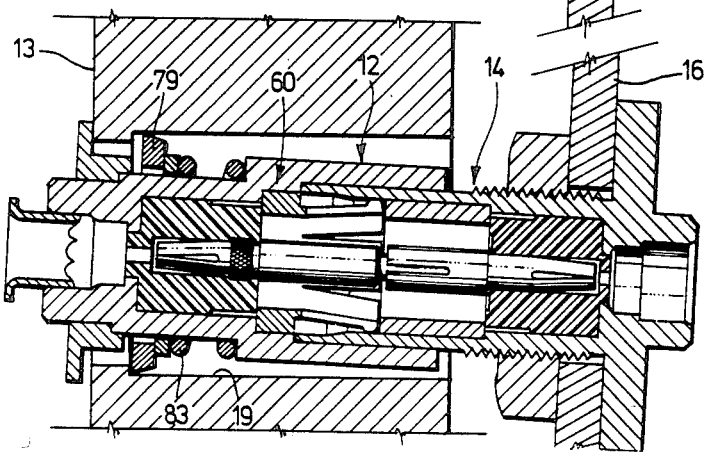

An outer contact 69 surrounds exposed center contact portion **67*b*. Outer contact 69 is electrically insulated from center contact portion 67*b* by air, and includes a plurality of spring fingers 69*a* which are adapted to electrically contact outer contact 34 and shell 32 of jack connector 14 upon mating of the connectors as shown in FIGS. 5 and 6. As shown, the spring fingers 69*a* diverge radially. In practice, they may be deflected radially inward by the contact 34 to project axially of the jack connector 14** without the radial divergence as shown.

A bushing 76 surrounds connector body portion 60 adjacent the rear end thereof. Bushing 76 is rigidly secured to shell 61 of body portion 60 and includes an outwardly extending annular flange 77.

The connector 12 is retained in panel 13 and panel aperture 19 by resilient means which permits insertion and mounting of the connector 12 to the panel 13 without tools, and automatic alignment of connector 12, when mounted, to reliably mate with connector 14 if connectors 12 and 14 do not share a common axis and connector 14 is substantially misaligned with connector 12. The resilient means includes a radially resilient part 79 and an axially resilient part 83. The radially resilient part 79 of the resilient means is a C-shaped, split retention ring loosely positioned around shell 61. Retention ring 79 provides a second flange spaced from the first flange 77 to define an annular groove 81 therebetween. The axially resilient part 83 of the resilient means is a coil spring 83 which also surrounds outer shell 61, as shown. One end **83*a* of spring 83 is biased against ring 79 via a washer 84, which is preferably positioned between the spring 83 and the retention ring 79. The opposite end 83b of spring 83 is in contact with and biased against shoulder 86 on shell 61. The length of spring 83 is such that it is compressed when positioned between ring 79 and shell 61. Retention ring 79 is thus forced toward the rear of the connector in the direction of the lower edge 82 of bushing 76**.

Plug connector 12 is thus adapted to be mounted to panel 13 and supported within an aperture 19. To mount connector 12 to panel 13, connector 12 is inserted into an aperture 19 in panel 13 in the direction indicated by arrow 85. The diameter of the connector body portion 60 is such that it will fit within aperture 19 with a slight clearance, and can be pushed substantially fully into aperture 19 until the split retention ring 79 encounters peripheral edge 88 of panel 13. Peripheral edge 88 will impinge upon the tapered surface 87 on retention ring 79, and upon further movement of connector 12 into aperture 19, edge 82 will urge ring 78 against the inwardly extending flange 91 of aperture 19. Ring 79 will be compressed inwardly to permit the retention ring 79 to clear the edge 88 and flange 91 of aperture 19, and insertion will continue until rigid first flange 77 impinges upon surface 89 of panel 13. When connector 12 is fully inserted in aperture 19, split retention ring 79 will clear internal shoulder 90 of inwardly extending flange 91 within aperture 19 and quickly expand outwardly to the position shown in FIG. 2 to lock the inwardly extending flange 91 of aperture 19 within the annular groove 81 between the retention ring 79 and the flange 77. Inwardly extending flange 91 has an axial length somewhat less than the axial length between flange 77 and edge 82 of bushing 76. The connector will thus be retained within the aperture 19 of panel 11 without the necessity of tools, bolts or other fastening elements normally needed to attach a connector to a panel. With the present invention, therefore, the entire connector 12 can be assembled together as a unit in the factory and shipped into the field in fully-assembled form for mounting to a panel. It is not necessary to ship the connector partially disassembled or to provide separate nuts and bolts or other fastening elements to attach the connector to the panel.

As a result of its resilient mounting means, i.e., split retention ring 79 and coil spring 83, connector body portion 60 is floatingly mounted within aperture 19 in panel 11 for movement axially, radially and angularly relative to panel 13, and is capable of automatically aligning itself with fixed jack connector 14 upon mating.

Figure 4:
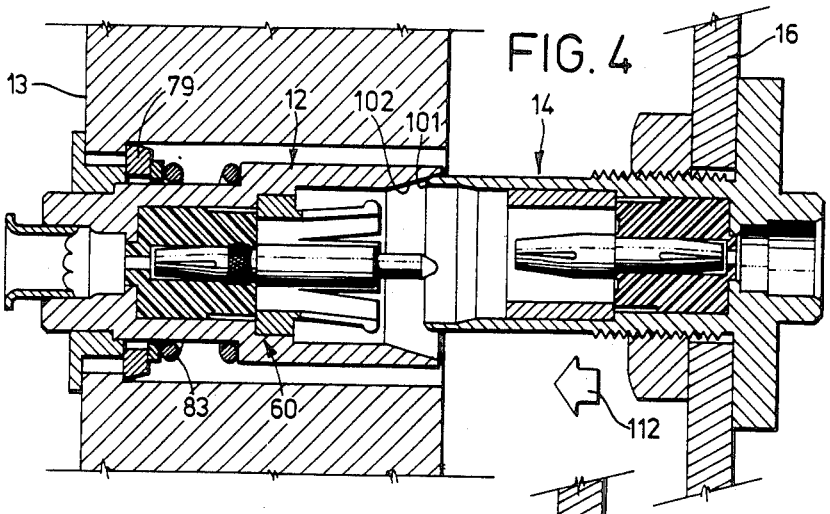
FIGS. 4–6 illustrate the capability of the plug connector of FIGS. 1–3 to compensate for various conditions of misalignment during mating.

Specifically, if connectors 12 and 14 are radially misaligned, the connector body 60 can shift radially to the extent permitted by the clearance between the inwardly extending flange 91 of the aperture 19 and the connector body portion 61 through the resilience of spring 83, as is illustrated in FIG. 4. When the jack and plug connectors are radially misaligned, front edge 101 of jack connector 14 will impinge upon tapered surface 102 of plug connector 12, and surface 102 will guide the two connectors into radial alignment for proper mating.

If connectors 12 and 14 are axially misaligned, connector body portion 60 is capable of shifting axially in the direction indicated by arrow 111 in FIG. 5 through the compression of coil spring 83. Compensation for axial misalignment permits the jack connector 14 to be fully inserted into the plug connector during mating and minimizes the possibility of breakage in achieving proper electrical coupling of both the outer and center contacts in the two connectors.

If connectors 12 and 14 are angularly misaligned, connector body portion 60 is capable of tilting to a slight extent as illustrated in FIG. 6. This capability exists because split retention ring 79 is resiliently supported on the connector body and can shift angularly as shown in FIG. 6. The extent of angular movement of the connector 12 is limited primarily by the diameter of aperture 19. By enclosing the floating connector body substantially fully within aperture 19, the connector body is prevented from excessive angular movement that can damage the connector or the electrical and mechanical connection between the jack and plug connectors.

In the embodiment illustrated herein, the connector body 60 is capable of up to 0.020 inches of radial movement and up to 0.060 inches of axial movement relative to panel 13, and is capable of an angular movement corresponding to these axial and radial movements. These numbers are exemplary only as the connector can be modified to provide greater or lesser movement depending on the requirements of the particular application in which it is used.

To remove the plug connector 12 from panel 11, it is only necessary to compress the split retention ring 79 sufficiently to allow the entire connector 12 to be withdrawn from the panel in the direction opposite that of arrow 85 in FIG. 2. This can be done by inserting an appropriate tool into aperture 19 to engage and compress the resilient split retention ring 79 until it can be withdrawn through the flange 91 of aperture 19.

While that has been described constitutes a presently most preferred embodiment of the invention, it should be understood that the invention can take various other forms. For example, although the invention is described as being incorporated into a coaxial connector assembly, the invention could also be practiced with triaxial and single contact connectors. Furthermore, other types of springs can be used to floatingly mount connector body portion 60 relative to panel 13. In addition, although a plug connector is described as the floating connector, it is possible, if desired, to design a jack connector to be floating. It is also possible to make both connectors floating for selected applications.

Because the invention can take many other forms, it should be understood that the invention should be limited only insofar as is required by the scope of the following claims.

We claim:

1. An electrical connector adapted to be inserted into and retained in an aperture in a panel comprising:

a connector body having at least one electrically conductive contact therein, and mounting means for mounting said connector body to said panel when said connector body is positioned in said aperture, said mounting means including first and second annular flanges extending outwardly from said connector body for receiving said panel therebetween when said connector body is positioned in said aperture, said second annular flange being moveable relative to the connector body for permitting insertion of said connector body into said aperture and for thereafter preventing the withdrawal of said connector body from said aperture, said mounting means further including spring means positioned between said connector body and said second annular flange for resilently supporting said connector body for movement relative to said panel for automatically aligning said connector body with a complementary connector during mating of said connector body with said complementary connector, said second annular flange comprises a split retention ring surrounding said connector body, said split retention ring being capable of being compressed inwardly during insertion of said connector body into said aperture to permit insertion of said connector body into said aperture, and of thereafter expanding outwardly for preventing the withdrawal of said connector from said aperture, and, said spring means comprises a coil spring having one end biased against said connector body and having an opposite end biased against said split retention ring.

2. The connector of claim 1 wherein said split retention ring includes a tapered surface portion for contacting the edge of said aperture during insertion of said connector body into said aperture, the edge of said aperture compressing said split retention ring for permitting insertion of said connector body into said apperture.

3. The connector of claim 1 wherein the thickness of said panel is such that said connector body is substantially fully positioned within said aperture when said connector is mounted to said panel.

4. The connector of claim 3 wherein said aperture includes a portion of reduced diameter defining an inwardly extending flange and wherein said split retention ring is compressed inwardly by said inwardly extending flange during insertion of said connector body into said aperture to permit insertion of said connector body into said aperture, and said split retension ring expands outwardly upon clearing said inwardly extending flange to retain said inwardly extending flange between said split retention ring and said first flange.

5. The connector of claim 1 wherein said connector comprises a coaxial connector.

6. A coaxial electrical connector adapted to be inserted into and retained in an aperture in a panel comprising:

a connector body, said connector body including at least one outer contact:

a center contact;

means for mounting said connector body to said panel, said mounting means including:

means for defining a first peripheral flange extending outwardly from said connector body;

a split retention ring loosely surrounding said connector body and defining a second peripheral flange extending outwardly from said connector body, said first flange and said split retention ring defining an annular groove therebetween for receipt of said panel to retain said connector on said panel, said retention ring being compressible inwardly relative to said connector body for permitting insertion of said connector body into said aperture, and thereafter expanding outwardly upon insertion of said connector body into said aperture for retaining said panel within said annular groove for preventing the withdrawal of said connector from said panel; and a coil spring surrounding said connector body and having one end biased against said connector body and the opposite end biased against said retention ring for resiliently supporting said connector body for movement axially and radially relative to said panel for automatically aligning said connector body with a complimentary connector during mating of said connector body with said complimentary connector.

7. The coaxial connector of claim 6 wherein said split retention ring includes a tapered surface portion for contacting the edge of said aperture during insertion of said connector body into said aperture, the edge of said aperture compressing said split retention ring during insertion of said connector body into said aperture to compress said split retention ring for permitting insertion of said connector body into said aperture.

8. The coaxial connector of claim 6 wherein said panel has a thickness such that said connector body is substantially fully positioned within said aperture when said connector is mounted to said panel, and wherein said aperture includes a portion of reduced diameter for defining an inwardly extending flange, said split retention ring being compressed by said inwardly extending flange during insertion of said connector body into said aperture until said split retention ring clears said inwardly extending flange at which time said retention ring expands outwardly to retain said inwardly extending flange between said first flange on said connector body and said split retention ring for retaining said connector body within said aperture.

9. An electrical connector as recited in claim 6, and further including: an axial passageway through the connector body, a rearward portion of said center contact axially within the connector body, a coaxial cable adapted for entering the passageway, said coaxial cable having a center conductor fitting in said rearward portion of said center contact and having an outer conductor exposed within said passageway, and a grip ring wedged against an internal wall of said passageway and surrounding the outer conductor to provide an electrical coupling of said outer conductor and said outer body.

10. An electrical connector as recited in claim 6, and further including: a tapered surface on a front end of said connector body for impingement by said complementary connector during said mating.

* * * * *